US007186088B2

(12) United States Patent
Havel et al.

(10) Patent No.: US 7,186,088 B2
(45) Date of Patent: Mar. 6, 2007

(54) LOW PRESSURE FAN WITH HIGH-FLOW

(75) Inventors: Brian Havel, London (CA); Mark Blissitt, London (CA)

(73) Assignee: Siemens VDO Automotive, a division of Siemens Canada Limited, Chatham (CA)

( * ) Notice: Subject to any disclaimer, the term of this patent is extended or adjusted under 35 U.S.C. 154(b) by 241 days.

(21) Appl. No.: 11/034,326

(22) Filed: Jan. 12, 2005

(65) Prior Publication Data

US 2005/0249597 A1 Nov. 10, 2005

Related U.S. Application Data

(60) Provisional application No. 60/535,964, filed on Jan. 12, 2004.

(51) Int. Cl.
*F04D 29/38* (2006.01)

(52) U.S. Cl. ..... 416/189; 416/203; 416/DIG. 5

(58) Field of Classification Search ..... 416/189, 416/203, DIG. 5
See application file for complete search history.

(56) References Cited

U.S. PATENT DOCUMENTS

| | | | | |
|---|---|---|---|---|
| 5,244,347 | A | 9/1993 | Gallivan et al. | 416/189 |
| 5,326,225 | A | 7/1994 | Gallivan et al. | 416/179 |
| 5,906,179 | A * | 5/1999 | Capdevila | 123/41.49 |
| 5,957,661 | A * | 9/1999 | Hunt et al. | 416/192 |
| 6,065,937 | A | 5/2000 | Hunt | 416/189 |
| 6,872,052 | B2 * | 3/2005 | Havel et al. | 416/189 |

OTHER PUBLICATIONS

PCT International Search Report mailed May 12, 2005.
PCT Written Opinion, mailed May 12, 2005.

* cited by examiner

*Primary Examiner*—Ninh H. Nguyen

(57) ABSTRACT

A fan 10 has a hub 12, a plurality of fan blades 14 attached to the hub at one end and extending outwardly from the hub, and a ring 18 concentric with the hub and coupled to tips 16 of the blades. Wherein a dimensionless radius (r/R) is defined from a center of the hub (r/R=0) radially outwardly, wherein each tip of the blades is r/R=1. A stagger angle is defined as an angle between an axis of rotation of the fan and a set angle of each fan blade, and C/R is a dimensionless chord length where C is chord. The fan is defined by values of r/R, C/R and stagger angle.

8 Claims, 2 Drawing Sheets

LOW PRESSURE FAN WITH HIGH-FLOW

This application is based on U.S. Provisional Application No. 60/535,964, filed on Jan. 12, 2004, and claims the benefit thereof for priority purposes.

FIELD OF THE INVENTION

The invention relates to a fan for moving a gas such as air and, more particularly, to a fan that is efficient in high volume forced air operation.

BACKGROUND OF THE INVENTION

Typical fans for moving air have a multiple number of blades fixed rigidly to a hub and surrounded by a ring to produce air flow when rotating. The usual problems with these fans, especially ones of large size, are (1) axial deflection, and (2) the stress level under centrifugal loading. Axial deflection of the fan is undesirable for reasons of interference with other components as well as for aerodynamic and aeroacoustic reasons. High blade stresses can lead to catastrophic failure of the fan. In conventional fan configurations, to add strength to the fan, the chord length is increased to fix the tip to the surrounding ring. These configurations add material to the outermost radial sections of the blade in order to achieve increased strength. However, the added mass contributes to excessive axial deflection.

Accordingly, there is a need to provide a fan in which axial deflection is minimized and the stresses are low while producing very high flow rates.

SUMMARY OF THE INVENTION

An object of the present invention is to fulfill the need referred to above. In accordance with the principles of the present invention, this objective is obtained by providing a fan having a hub, a plurality of fan blades attached to the hub at one end and extending outwardly from the hub, and a ring concentric with the hub and coupled to tips of the blades. Wherein a dimensionless radius (r/R) is defined from a center of the hub (r/R=0) radially outwardly, wherein each tip of the blades is r/R=1. A stagger angle is defined as an angle between an axis of rotation of the fan and a set angle of each fan blade, and C/R is a dimensionless chord length where C is chord, the fan defined generally by:

| r/R | Stagger angle | C/R |
|---|---|---|
| 0.387 | 56.0 | 0.298 |
| 0.418 | 56.8 | 0.294 |
| 0.449 | 57.7 | 0.289 |
| 0.479 | 59.0 | 0.285 |
| 0.510 | 60.5 | 0.281 |
| 0.540 | 62.2 | 0.277 |
| 0.571 | 63.9 | 0.272 |
| 0.602 | 65.5 | 0.268 |
| 0.632 | 67.0 | 0.264 |
| 0.663 | 68.3 | 0.260 |
| 0.694 | 69.3 | 0.255 |
| 0.724 | 70.2 | 0.247 |
| 0.755 | 70.8 | 0.238 |
| 0.786 | 71.3 | 0.230 |
| 0.816 | 71.8 | 0.221 |
| 0.847 | 72.2 | 0.213 |
| 0.877 | 72.8 | 0.204 |
| 0.908 | 73.4 | 0.196 |
| 0.939 | 74.0 | 0.187 |

-continued

| r/R | Stagger angle | C/R |
|---|---|---|
| 0.969 | 74.4 | 0.179 |
| 1.000 | 74.5 | 0.170 |

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
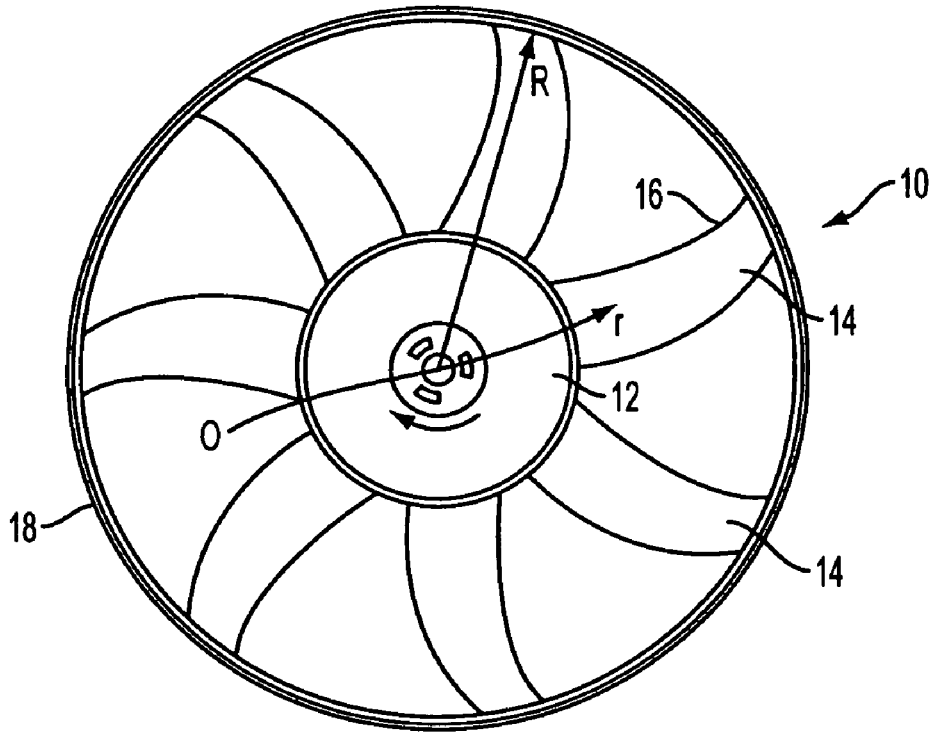
FIG. 1 is a front view of a fan provided in accordance with the principles of the present invention.

With reference to FIG. 1, a high-flow, low-pressure fan is shown, generally indicated at 10, in accordance with the principles of the present invention. The fan 10 includes a circular hub 12, to which multiple blades 14 are attached circumferentially. In the embodiment, 7 blades are provided. The blades can be spaced evenly or unevenly spaced about the hub. The blade tips 16 are coupled to a ring 18 that is concentric with the hub 12. A dimensionless radius (r/R) is defined from the center ○ of the hub 12 (this point is r/R=0) radially outwards, where the tip 16 of the blade (not counting the ring 18) is r/R=1. R is the radius of the fan from the center of the hub to the tip of the blade and r is a radius of the fan from the center of the hub to a point on a blade.

Figure 2:
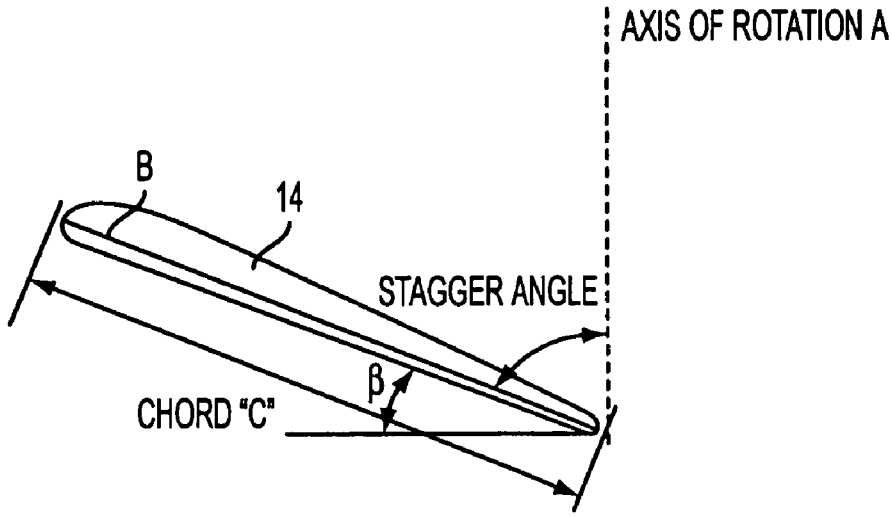
FIG. 2 is a view of an airfoil profile defining chord and stagger angle.

As shown in FIG. 2, the stagger angle is inscribed between the axis of rotation A and the set axis B of the fan blade 14. A dimensionless cord length is defined as C/R with C being the chord as shown in FIG. 2. Each blade has a conventional airfoil shape in cross-section. Data for the fan of an embodiment is presented in the Table 1 below.

TABLE 1

| r/R | Stagger angle | C/R |
|---|---|---|
| 0.387 | 56.0 | 0.298 |
| 0.418 | 56.8 | 0.294 |
| 0.449 | 57.7 | 0.289 |
| 0.479 | 59.0 | 0.285 |
| 0.510 | 60.5 | 0.281 |
| 0.540 | 62.2 | 0.277 |
| 0.571 | 63.9 | 0.272 |
| 0.602 | 65.5 | 0.268 |
| 0.632 | 67.0 | 0.264 |

TABLE 1-continued

| r/R | Stagger angle | C/R |
|---|---|---|
| 0.663 | 68.3 | 0.260 |
| 0.694 | 69.3 | 0.255 |
| 0.724 | 70.2 | 0.247 |
| 0.755 | 70.8 | 0.238 |
| 0.786 | 71.3 | 0.230 |
| 0.816 | 71.8 | 0.221 |
| 0.847 | 72.2 | 0.213 |
| 0.877 | 72.8 | 0.204 |
| 0.908 | 73.4 | 0.196 |
| 0.939 | 74.0 | 0.187 |
| 0.969 | 74.4 | 0.179 |
| 1.000 | 74.5 | 0.170 |

Figure 3:
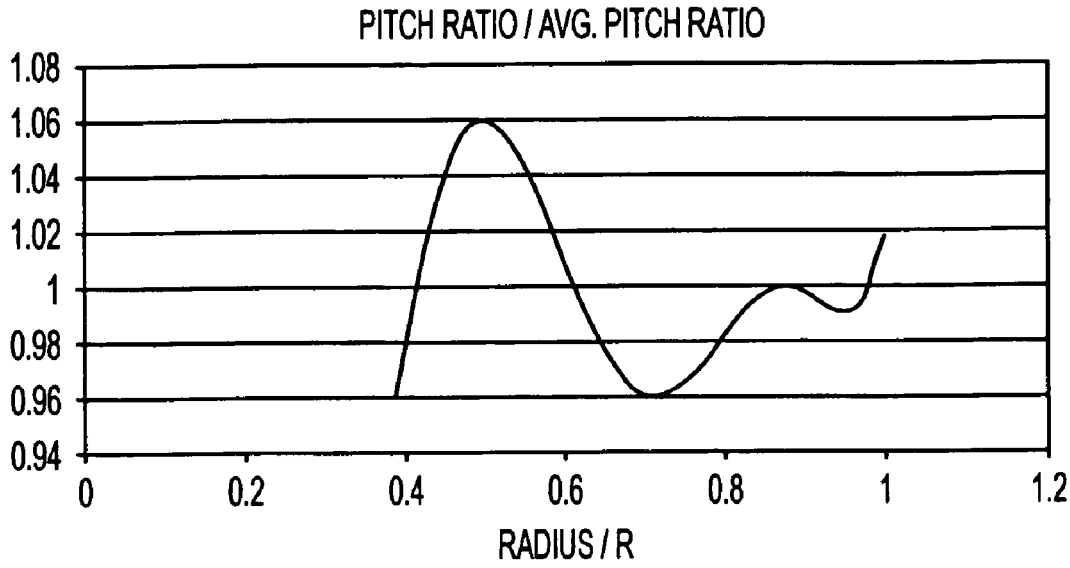
FIG. 3 is a graph showing the relationship of $P/P_{ave}$ )/dr and r/R for the data of Table 2.
Figure 4:
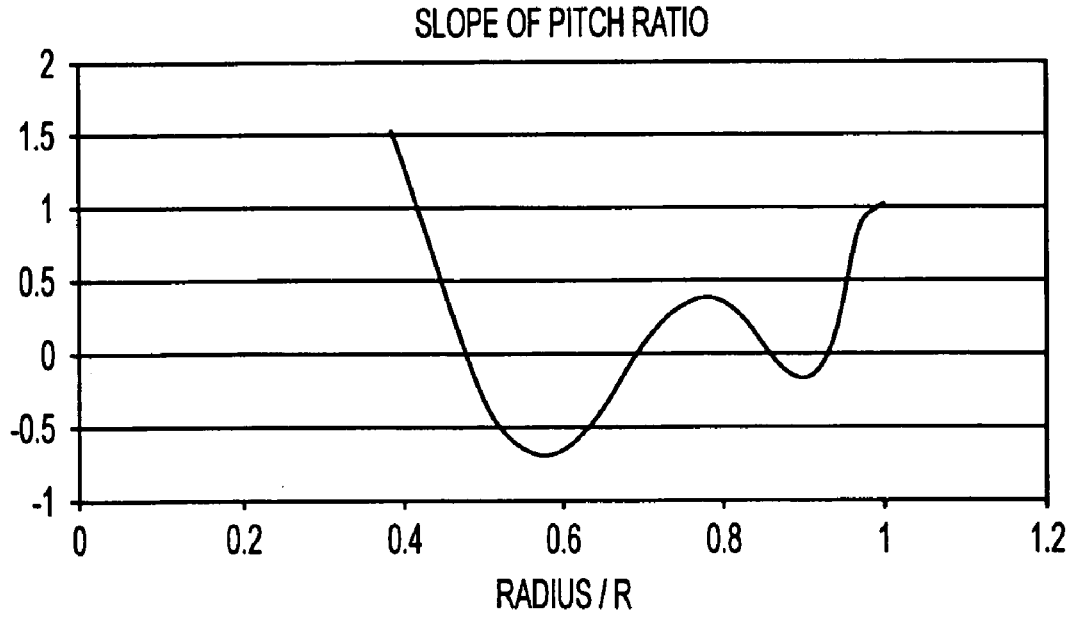
FIG. 4 is a graph showing the relationship of $d(P/P_{ave})/dr$ and r/R for the data of Table 2.

The data of Table 1 can be represented in a non-dimensional manner as shown below in Table 2 and which is depicted in graphical format in FIGS. 3 and 4.

TABLE 2

| r/R | $P/P_{ave}$ | $d(P/P_{ave})/dr$ |
|---|---|---|
| 0.3872 | 0.9593 | 1.5250 |
| 0.4179 | 1.0060 | 1.1001 |
| 0.4485 | 1.0398 | 0.5407 |
| 0.4791 | 1.0563 | 0.0314 |
| 0.5098 | 1.0573 | −0.3643 |
| 0.5404 | 1.0461 | −0.6134 |
| 0.5711 | 1.0273 | −0.7088 |
| 0.6017 | 1.0056 | −0.6640 |
| 0.6323 | 0.9853 | −0.5079 |
| 0.6630 | 0.9697 | −0.2804 |
| 0.6936 | 0.9611 | −0.0296 |
| 0.7243 | 0.9602 | 0.1934 |
| 0.7549 | 0.9661 | 0.3405 |
| 0.7855 | 0.9766 | 0.3756 |
| 0.8162 | 0.9881 | 0.2864 |
| 0.8468 | 0.9968 | 0.0983 |
| 0.8774 | 0.9999 | −0.1107 |
| 0.9081 | 0.9965 | −0.1945 |
| 0.9387 | 0.9905 | 0.0776 |
| 0.9694 | 0.9929 | 0.8385 |
| 1.0000 | 1.0186 | 1.0186 |

In Table 2, the Pitch ratio (P) is defined as $(r/R)*2\pi*\tan(\beta)$, where β (FIG. 2) is the pitch angle in radians, r is fan blade radial position, R is the fan blade tip radius (FIG. 1). Average pitch ratio is ($P_{ave}$) the geometric mean of the pitch ratio computed over the blade radius from the blade root to the blade tip. Slope of pitch ratio is defined as the mathematical first derivative of the pitch ratio/average pitch ratio, written symbolically as $d(P/P_{ave})/dr$.

The fan 10 advantageously produces air at very high flow rates even when the wake of the fan is highly restricted by obstacles. Therefore, this fan is highly suited for automobile engine cooling, where the wake of the fan is blocked by the automotive engine and in applications with high flow rate requirements and those where the fan must withstand stresses due to rotations high RPM levels. The fan 10 has a high structural integrity due to its minimized axial deflection and low stresses.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fan comprising:

a hub, a plurality of fan blades attached to the hub at one end and extending outwardly from the hub, and a ring concentric with the hub and coupled to tips of the blades, wherein a dimensionless radius (r/R) is defined from a center of the hub (r/R=0) radially outwardly, wherein each tip of the blades is r/R=1, wherein a stagger angle is defined as an angle between an axis of rotation of the fan and a set angle of each fan blade, and C/R is a dimensionless chord length where C is chord, the fan defined generally by:

| r/R | Stagger angle | C/R |
|---|---|---|
| 0.387 | 56.0 | 0.298 |
| 0.418 | 56.8 | 0.294 |
| 0.449 | 57.7 | 0.289 |
| 0.479 | 59.0 | 0.285 |
| 0.510 | 60.5 | 0.281 |
| 0.540 | 62.2 | 0.277 |
| 0.571 | 63.9 | 0.272 |
| 0.602 | 65.5 | 0.268 |
| 0.632 | 67.0 | 0.264 |
| 0.663 | 68.3 | 0.260 |
| 0.694 | 69.3 | 0.255 |
| 0.724 | 70.2 | 0.247 |
| 0.755 | 70.8 | 0.238 |
| 0.786 | 71.3 | 0.230 |
| 0.816 | 71.8 | 0.221 |
| 0.847 | 72.2 | 0.213 |
| 0.877 | 72.8 | 0.204 |
| 0.908 | 73.4 | 0.196 |
| 0.939 | 74.0 | 0.187 |
| 0.969 | 74.4 | 0.179 |
| 1.000 | 74.5 | 0.170. |

2. The fan of claim 1, wherein seven blades are provided.

3. The fan of claim 1, wherein each blade has an airfoil shape in cross-section.

4. The fan of claim 1, wherein the blades are spaced unevenly about the hub.

5. A fan comprising:

a hub, a plurality of fan blades attached to the hub at one end and extending outwardly from the hub, and a ring concentric with the hub and coupled to tips of the blades, wherein a dimensionless radius (r/R) is defined from a center of the hub (r/R=0) radially outwardly, wherein each tip of the blades is r/R=1, wherein Pitch ratio (P) is defined as $(r/R)*2\pi*\tan(\beta)$, where β is the pitch angle in radians, r is fan blade radial position, R is the fan blade tip radius, average pitch ratio is ($P_{ave}$) the geometric mean of the pitch ratio computed over the blade radius from the blade root to the blade tip, and slope of pitch ratio is defined as the mathematical first derivative of the pitch ratio/average pitch ratio, and is represented as $d(P/P_{ave})/dr$, the fan defined generally by

| r/R | $P/P_{ave}$ | $d(P/P_{ave})/dr$ |
|---|---|---|
| 0.3872 | 0.9593 | 1.5250 |
| 0.4179 | 1.0060 | 1.1001 |
| 0.4485 | 1.0398 | 0.5407 |

-continued

| r/R | $P/P_{ave}$ | $d(P/P_{ave})/dr$ |
|---|---|---|
| 0.4791 | 1.0563 | 0.0314 |
| 0.5098 | 1.0573 | −0.3643 |
| 0.5404 | 1.0461 | −0.6134 |
| 0.5711 | 1.0273 | −0.7088 |
| 0.6017 | 1.0056 | −0.6640 |
| 0.6323 | 0.9853 | −0.5079 |
| 0.6630 | 0.9697 | −0.2804 |
| 0.6936 | 0.9611 | −0.0296 |
| 0.7243 | 0.9602 | 0.1934 |
| 0.7549 | 0.9661 | 0.3405 |
| 0.7855 | 0.9766 | 0.3756 |
| 0.8162 | 0.9881 | 0.2864 |
| 0.8468 | 0.9968 | 0.0983 |
| 0.8774 | 0.9999 | −0.1107 |

-continued

| r/R | $P/P_{ave}$ | $d(P/P_{ave})/dr$ |
|---|---|---|
| 0.9081 | 0.9965 | −0.1945 |
| 0.9387 | 0.9905 | 0.0776 |
| 0.9694 | 0.9929 | 0.8385 |
| 1.0000 | 1.0186 | 1.0186. |

6. The fan of claim 5, wherein seven blades are provided.

7. The fan of claim 5, wherein each blade has an airfoil shape in cross-section.

8. The fan of claim 5, wherein the blades are spaced unevenly about the hub.

* * * * *